US008564504B2

(12) United States Patent
Hsu et al.

(10) Patent No.: US 8,564,504 B2
(45) Date of Patent: Oct. 22, 2013

(54) PIXEL ARRAY AND DRIVING METHOD THEREOF

(75) Inventors: Li-Chih Hsu, Taipei (TW); Chia-Chiang Hsaio, Changhua County (TW)

(73) Assignee: Au Optronics Corporation, Hsinchu (TW)

( * ) Notice: Subject to any disclaimer, the term of this patent is extended or adjusted under 35 U.S.C. 154(b) by 653 days.

(21) Appl. No.: 12/369,734

(22) Filed: Feb. 11, 2009

(65) Prior Publication Data

US 2010/0149142 A1 Jun. 17, 2010

(30) Foreign Application Priority Data

Dec. 11, 2008 (TW) ..... 97148281 A

(51) Int. Cl.
*G09G 3/20* (2006.01)

(52) U.S. Cl.
USPC ..... 345/55; 345/204; 345/205

(58) Field of Classification Search
None
See application file for complete search history.

(56) References Cited

U.S. PATENT DOCUMENTS 5,151,689 A 9/1992 Kabuto et al.
5,619,225 A * 4/1997 Hashimoto ..... 345/98
6,100,955 A * 8/2000 Yanagawa et al. ..... 349/141
6,583,777 B2 6/2003 Hebiguchi et al.
2006/0097628 A1* 5/2006 Suh et al. ..... 313/504
2007/0070017 A1* 3/2007 Wei et al. ..... 345/98
2007/0178617 A1* 8/2007 Tsai et al. ..... 438/30
2008/0068516 A1 3/2008 Mori et al.

FOREIGN PATENT DOCUMENTS

CN 1808250 7/2006
TW 200713177 4/2007

OTHER PUBLICATIONS

"1st Office Action of China counterpart application", issued on Apr. 13, 2010, p. 1-p. 4.
"Office Action of Taiwan counterpart application" issued on Nov. 28, 2012, p. 1-p. 9.

* cited by examiner

*Primary Examiner* — Joseph Haley
(74) *Attorney, Agent, or Firm* — Jianq Chyun IP Office

(57) ABSTRACT

A pixel array including scan lines, data lines and pixels is provided. Scan lines extend along a row direction and include first and second scan lines. The first and second scan lines are arranged alternately along a column direction. Data lines extend along the column direction in a zigzag manner and include a first data line, a second data line connected to the first data line, a third data line disposed between the first and second data lines, and a fourth data line connected to the third data line. The pixels connect with corresponding scan lines and data lines. Pixels connected with the same data line are not aligned in the column direction; pixels connected with the same data line are only arranged at the same side of the data line. Pixels of any two adjacent rows are separated by a first scan line and a second scan line.

18 Claims, 6 Drawing Sheets

PIXEL ARRAY AND DRIVING METHOD THEREOF

CROSS-REFERENCE TO RELATED APPLICATION

This application claims the priority benefit of Taiwan application serial no. 97148281, filed Dec. 11, 2008. The entirety of the above-mentioned patent application is hereby incorporated by reference herein and made a part of specification.

BACKGROUND OF THE INVENTION

1. Field of the Invention

The present invention relates to a display array and a driving method thereof, and more particularly to a pixel array and a driving method thereof.

2. Description of Related Art

In order to meet the requirements of high speed, high efficiency, light weight and compact size for modern appliances, all electronic parts have been enthusiastically developed towards miniaturization. All sorts of mobile electronic devices have become the mainstream, e.g., notebook computers, cell phones, electronic dictionaries, personal digital assistants (PDA), web pads, and tablet personal computers (PC). In order to satisfy the demand for miniaturized products, among image displays of mobile electronic devices, flat panel displays having superior characteristic such as good space utilization, high resolution, low power consumption and no radiation have been extensively applied nowadays.

Generally, a flat panel display is constituted by a display panel and a plurality of driver ICs. The display panel has a pixel array, and pixels in the pixel array are driven by corresponding scan lines and corresponding data lines. In order for flat panel displays to prevail in the market, manufacturers all fervently strive to reduce process costs. In recent years, a technology for reducing data drivers by half is proposed, which mainly modifies the layout on the pixel array to reduce the number of data drivers actually used.

FIG. 1 is a schematic view of a pixel array of a conventional flat panel display. Referring to FIG. 1, a pixel array 100 has a plurality of pixels R, G and B, scan lines 110 and data lines 120. Pixels R, G and B are arranged in array. Scan lines 110 and data lines 120 are respectively connected to the pixels R, G and B. Parts of pixels of two adjacent columns are connected to the same data line, as shown by a data line 120A in FIG. 1. As shown in FIG. 1, since the pixels of the two adjacent columns shared the same data line which transmits corresponding data signals, the number of the data lines can be reduced by half to reduce the number of data drivers as required under this framework.

In U.S. Pat. No. 5,151,689, another pixel array structure is proposed, in which the layout of the pixel array is roughly similar to the pixel array 100 of FIG. 1, and the corresponding data signals are inputted to the pixels of the two columns through the same data line at different times so as to achieve the same purpose of reducing data/source drivers by half.

SUMMARY OF THE INVENTION

The present invention provides a pixel array having data lines substantially arranged in a zigzag manner. The pixel array is capable of reducing a number of external data drivers.

The present provides a driving method of a pixel array; the method is capable of reducing consumption of electricity to lower costs.

The present invention provides a pixel array including a plurality of scan lines, a plurality of data lines and a plurality of pixels. The plurality of scan lines extend along a row direction and include a plurality of first scan lines and a plurality of second scan lines. The first scan lines and the second scan lines are arranged alternately along a column direction. The plurality of data lines extend along the column direction in a zigzag manner. The data lines include a first data line, a second data line, a third data line, and a fourth data line, wherein the second data line is connected to the first data line, the third data line is disposed between the first data line and the second data line, and the fourth data line is connected to the third data line. The pixels are connected to the corresponding scan lines and the corresponding data lines. The pixels connected to the same data line are not aligned in the column direction, and the pixels connected to the same data line are only distributed at the same side of the data line, and the pixels of any two adjacent rows are separated by one of the first scan lines and one of the second scan lines.

According to an embodiment of the present invention, any one of the first data line, the second data line, the third data line and the fourth data line includes a plurality of first conductive lines and a plurality of second conductive lines. The first conductive lines extend along the row direction; the second conductive lines extend along the column direction, and the first conductive lines and the second conductive lines are connected.

According to an embodiment of the present invention, a portion of the pixels connected to the first data line and a portion of the pixels connected to the fourth data line are aligned in the column direction, and a portion of the pixels connected to the second data line and a portion of the pixels connected to the third data line are aligned in the column direction.

According to an embodiment of the present invention, the pixels of even-numbered rows and the pixels of odd-numbered rows are not aligned in the column direction. Meanwhile, in the row direction, a shift among the pixels of different rows is one-$N^{th}$ (1/N) of a width of a pixel, $N \geq 2$.

According to an embodiment of the present invention, in the pixels of the same row, the portions of the pixels connected to the first data line and the third data line are connected to one of the first scan lines, and the portions of the pixels connected to the second data line and the fourth data line are connected to one of the second scan lines.

The present invention further provides a driving method of a pixel array, which is suitable for driving the pixel array. The driving method of the pixel array includes the following steps. An on-state voltage level is sequentially inputted to the first scan lines and the second scan lines to turn on the corresponding pixels sequentially. The driving method of the pixels of the same row includes the following steps. A data voltage of a first polarity and a data voltage of a second polarity are inputted to the pixels connected to the first scan line through the first data line and the third data line respectively. The first polarity and the second polarity are different. Moreover, the data voltage of the first polarity and the data voltage of the second polarity are inputted to the pixels connected to the second scan line through the second data line and the fourth data line respectively.

According to an embodiment of the present invention, the polarities of the data voltages transmitted by each of the data lines remain unchanged within the same frame time.

According to an embodiment of the present invention, the driving method of the pixel array further includes inputting an on-state voltage level to the first scan line and the second scan line connected to pixels of the next row so as to turn on the pixels of the next row. The driving method of the pixels of the next row includes the following steps. The data voltage of the second polarity and the data voltage of the first polarity are inputted respectively to the pixels connected to the first scan line through the first data line and the third data line. The first polarity and the second polarity are different. Further, the data voltage of the second polarity and the data voltage of the first polarity are inputted to the pixels connected to the second scan line through the second data line and the fourth data line respectively.

According to the foregoing, in the pixel array of the present invention, the data lines are designed to be arranged in a zigzag layout, and the pixels connected to the same data line are disposed at the same side of the data line. Consequently, the pixel array achieves a display effect of dot inversion driving mode by a simpler driving method, and products with high quality are manufactured at a lower cost.

To make the above and other objectives, features, and advantages of the present invention more comprehensible, several embodiments accompanied with figures are detailed as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

The First Embodiment

Figure 1:
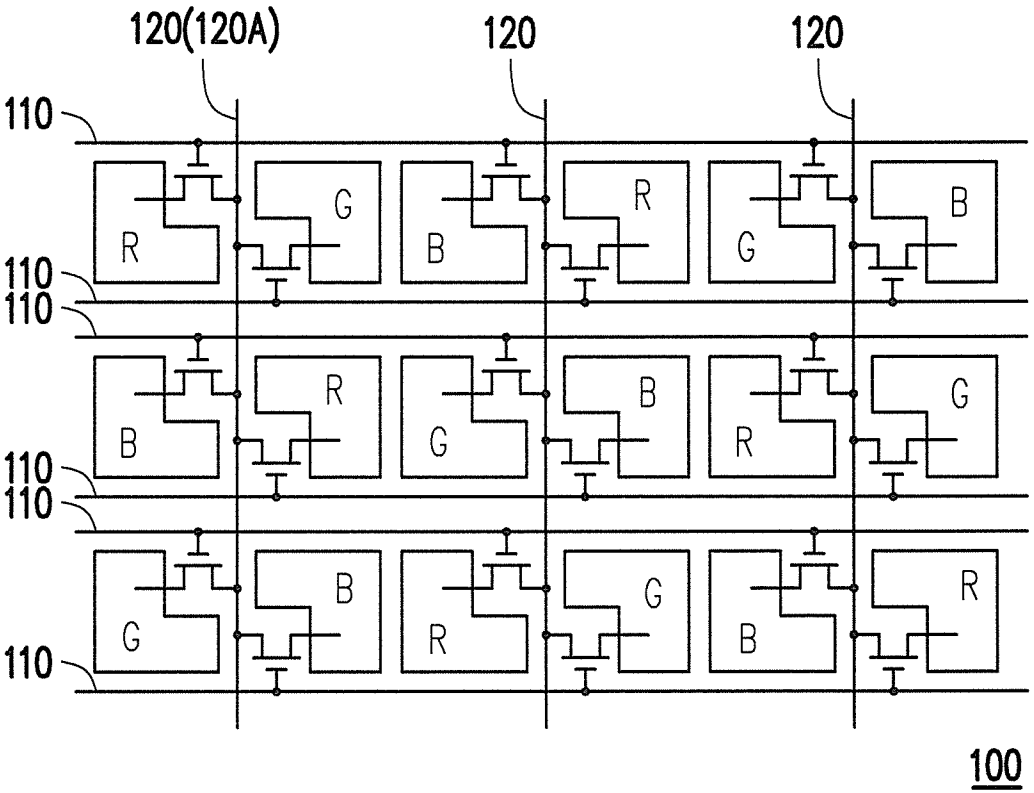
FIG. 1 (PRIOR ART)
FIG. 1 is a schematic view of a pixel array of a conventional flat panel display.
Figure 2A:
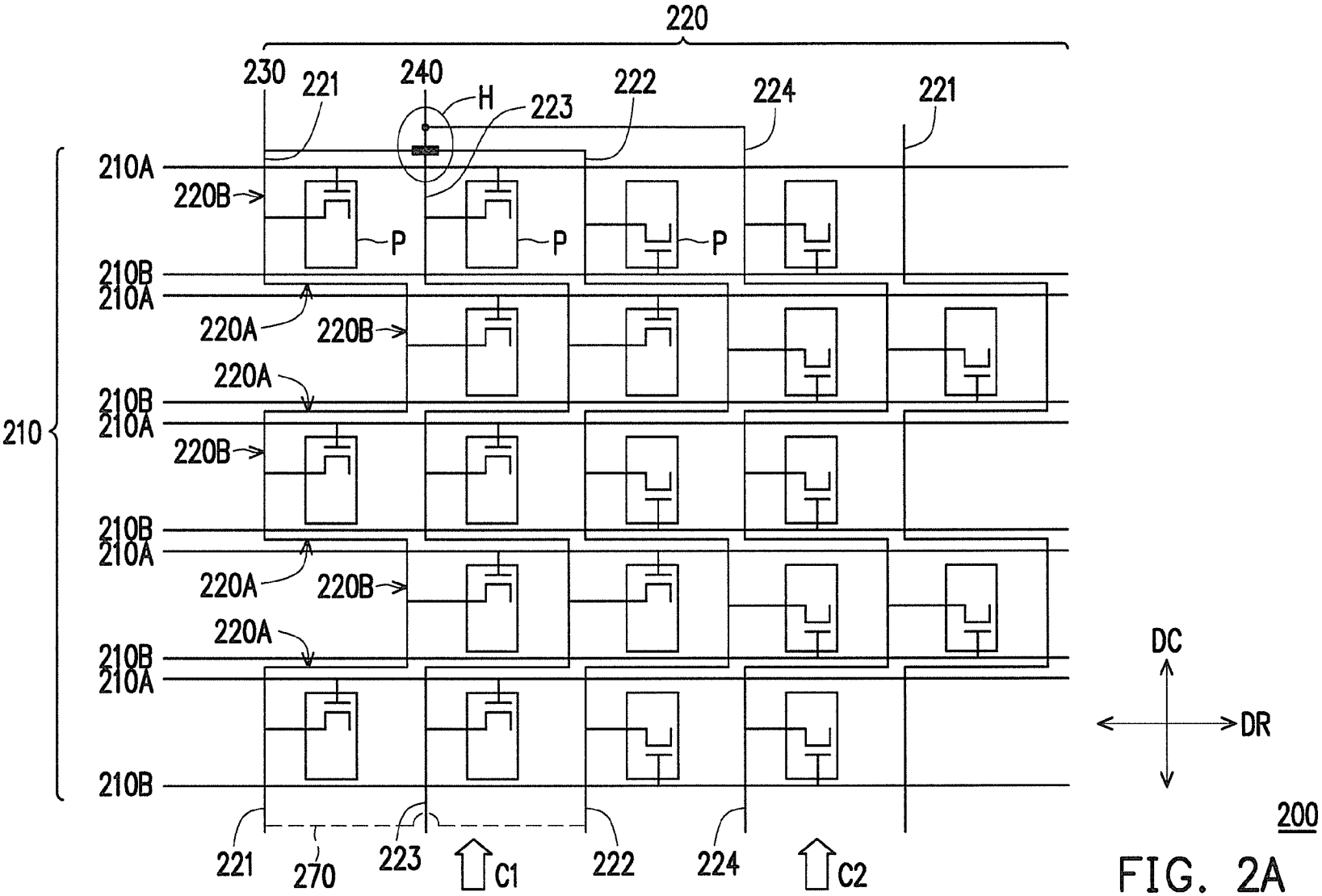
FIG. 2A is a schematic layout diagram of a pixel array according to an embodiment of the present invention.

FIG. 2A is a schematic layout diagram of a pixel array of the present invention. Referring to FIG. 2A, a pixel array 200 includes a plurality of scan lines 210, a plurality of data lines 220 and a plurality of pixels P. To facilitate illustration, a row direction DR and a column direction DC are designated, and the row direction DR is substantially perpendicular to the column direction DC. As shown in FIG. 2A, the scan lines 210 extend along the row direction DR, and the scan lines 210 are mainly constituted by a plurality of first scan lines 210A and a plurality of second scan lines 210B. The first scan lines 210A and the second scan lines 210B are arranged alternately along the column direction DC. For example, the pixels P of each row correspond to one of the first scan lines 210A and one of the second scan lines 210B, as shown in FIG. 2A. In addition, the data lines 220 roughly extend along the column direction DC in a zigzag manner, and the data lines 220 are mainly constituted by the first data line 221, the second data line 222, the third data line 223 and the fourth data line 224. The second data line 222 is connected to the first data line 221; the third data line 223 is disposed between the first data line 221 and the second data line 222, and the fourth data line 224 is connected to the third data line 223.

More specifically, the data lines 220 in the pixel array 200 are arranged repeatedly towards the row direction DR in a unit of the first data line 221, the second data line 222, the third data line 223 and the fourth data line 224. For example, in FIG. 2A, a set of data lines 220 are arranged in a sequence from left to right as the first data line 221, the third data line 223, the second data line 222 and the fourth data line 224. A next set of data lines 220 follow the fourth data line 224 and are arranged repeatedly in the foregoing sequence. In other words, the fourth data line 224 of the set is disposed between the second data line 222 of the set and the first data line 221 of the next set.

Referring to FIG. 2A, the pixels P are connected to the corresponding scan lines 210 and the corresponding data lines 220 respectively. The pixels P of any two adjacent rows are separated by one of the first scan lines 210A and one of the second scan lines 210B. Moreover, according to the present embodiment, a portion of the pixels P of the same row connected to the first data line 221 and the third data line 223 are connected with the first scan line 210A, and a portion of the pixels P connected to the second data line 222 and the fourth data line 224 are connected with the second scan line 210B, for example. According to other embodiments, the scan lines 210 with which the foregoing pixels P connected to the different data lines 220 are connected can also be interchanged. The present invention does not limit in this aspect. Thus, the first scan line 210A and the second scan line 210B can be controlled according to a timing sequence and inputted line by line with an on-state voltage level $V_{gh}$ to the pixels P of different rows. A detailed description of the driving mechanism is provided below. Particularly, the pixels P connected to the same data line 220 are only distributed at the same side of the data line 220, and hence the pixels P connected to the same data line 220 are arranged in a zigzag manner or in a curve manner in the row direction DR roughly along a direction of the data line 220 such that the pixels P connected to the same data line 220 are not aligned in the column direction DC. According to the present embodiment, each of the data lines 220 is generally arranged in a zigzag layout. In detail, taken as a whole, each of the data lines 220 is arranged roughly along the row direction DR, and specifically each of the data lines 220 is mainly constituted by a plurality of first conductive lines 220A extending along the row direction DR and a plurality of second conductive lines 220B extending along the column direction DC. The first conductive lines 220A and the second conductive lines 220B are connected alternately to form the data lines 220 in a zigzag shape as shown in FIG. 2A. It should be noted that in the present embodiment the portion of the pixels P connected to the first data line 221 are, for example, aligned with the portion of the pixels P connected to the third data line 223 in the column direction DC. For example, in a column C1 of FIG. 2A, the pixels P connected to the third data line 223, the pixels P connected to the first data line 221, the pixels P connected to the third data line 223 and the pixels P connected to the first data line 221 are arranged in sequence as such from top to bottom. From another aspect, the portion of the pixels P connected to the second data line 222 are, for example, aligned with the portion of the pixels P connected to the fourth data line 224 in the column direction DC. For example, in a column C2 of FIG. 2A, the pixels P connected to the third data line 224, the pixels P connected to the fourth data line 224, the pixels P connected to the second data line 222, the pixels P connected to the fourth data line 224 and the pixels P connected to the second data line 222 are arranged in sequence as such from top to bottom. Therefore, in the present embodiment, a display effect of dot inversion is achieved through a proper layout of the data lines 220 and the pixels P by a simpler driving method.

It should be noted that as shown in FIG. 2A, the first data line 221 and the second data line 222 are connected to each other and share one common conductive line, e.g., a first common conductive line 230 in FIG. 2A. The third data line 223 and the fourth data line 224 are connected to each other with another common conductive line, e.g., a second common conductive line 240 in FIG. 2A. In a frame time, a driving method of applying corresponding data voltages of different polarities to the first common conductive line 230 and the second common conductive line 240, which is called column inversion. Hence, in application, the first data line 221 and the second data line 222 can be connected to data drivers through the same common conductive line, and the third data line 223 and the fourth data line 224 can be connected to data drivers through another common conductive line. Consequently, the pixel array 200 of the present invention reduces the additional data drivers by half. Furthermore, since the pixels P connected to the same data line 220 are not aligned in the column direction DC, a simpler driving method can be applied, e.g., column inversion or row inversion, so that the pixel array 200 achieves the display effect of dot inversion.

Figure 2B:
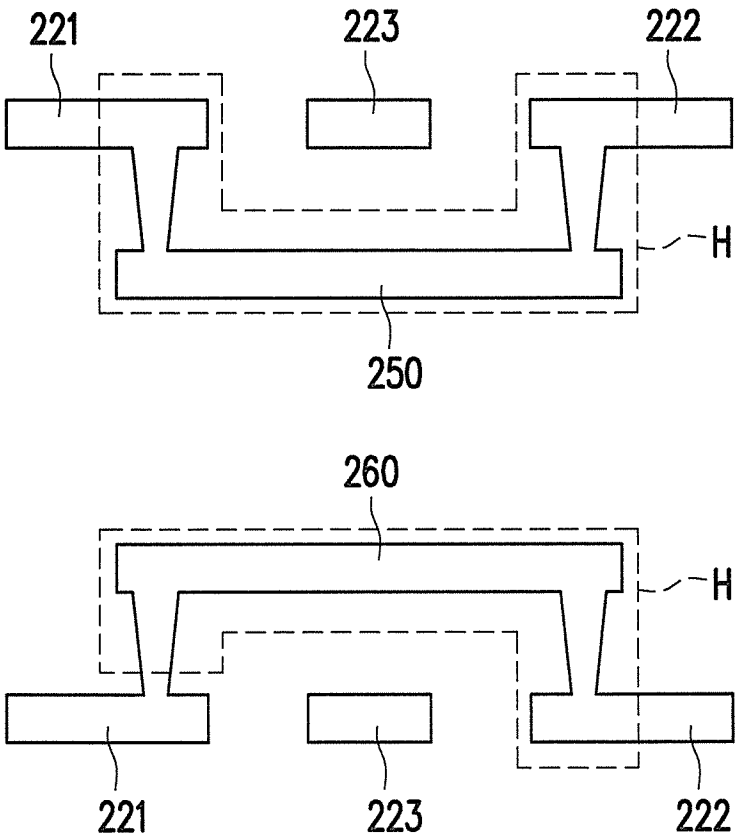
FIG. 2B are two schematic cross-sectional views of the wire jumping area in FIG. 2A.

It should be explained that a junction of the first data line 221 and the second data line 222 crosses the third data line 223, as shown by a wire jumping area H in FIG. 2A. In other words, the first data line 221 is electrically connected to the second data line 222 through the wire jumping area H, and the third data line 223 is electrically isolated from the first data line 221 and the second data line 222 by the wire jumping area H. Specifically, an interlayer design of the wire jumping area H is exemplified by FIG. 2B. FIG. 2B are two schematic cross-sectional views of the wire jumping area in FIG. 2A. Referring to an upper part of FIG. 2B, the first data line 221 and the second data line 222 are formed by the same layer, and the first data line 221 and the second data line 222 are connected through an underneath conductive layer 250, for example. A material of the underneath conductive layer 250 is, for example, the same as a material of the scan line 210. In other words, when manufacturing the scan line 210, the underneath conductive layer 250 connecting the first data line 221 and the second data line 222 is simultaneously manufactured to form the wire jumping area H. Conceivably, the wire jumping area H of the first data line 221 and the second data line 222 can also be designed as being connected through an upper conductive layer 260, as shown in FIG. 2B. A material of the upper conductive layer 260 can be the same material used for manufacturing pixel electrodes, which means while manufacturing the pixel electrodes, the upper conductive layer 260 connecting the first data line 221 and the second data line 222 can be simultaneously manufactured to form the wire jumping area H. In other words, openings which expose the first data line 221 and the second data line 222 respectively are simultaneously manufactured while performing a patterning process of a protection layer over the data lines, and afterwards when disposing the pixel electrodes, the upper conductive layer 260 is simultaneously disposed to form the wire jumping area H as shown in a lower part of FIG. 2B. Since the present embodiment is not limited to this design, existing process and materials can be used, and only partial modification needs to be made on the original photomask to manufacture the wire jumping area by the same process so that the problem in the prior art where one more entire protection layer and one more entire conductive layer are required to manufacture the wire jumping area thus increasing manufacturing costs is solved.

It should be noted that in order to ensure that the first data line 221 and the second data line 222 are connected to each other such that voltages of the first data line 221 and the second data line 222 are rendered as having equivalent levels, a connecting conductive line 270 can also be disposed in a proper position between the first data line 221 and the second data line 222, as shown by dotted-lined areas in FIG. 2B. In other words, when open defects happened in the first data line 221 and the second data line 222 during the process, proper repair is performed by the disposition of the connecting conductive line 270 so as to restrain the chance of line defect in the pixel array 200.

Figure 3:
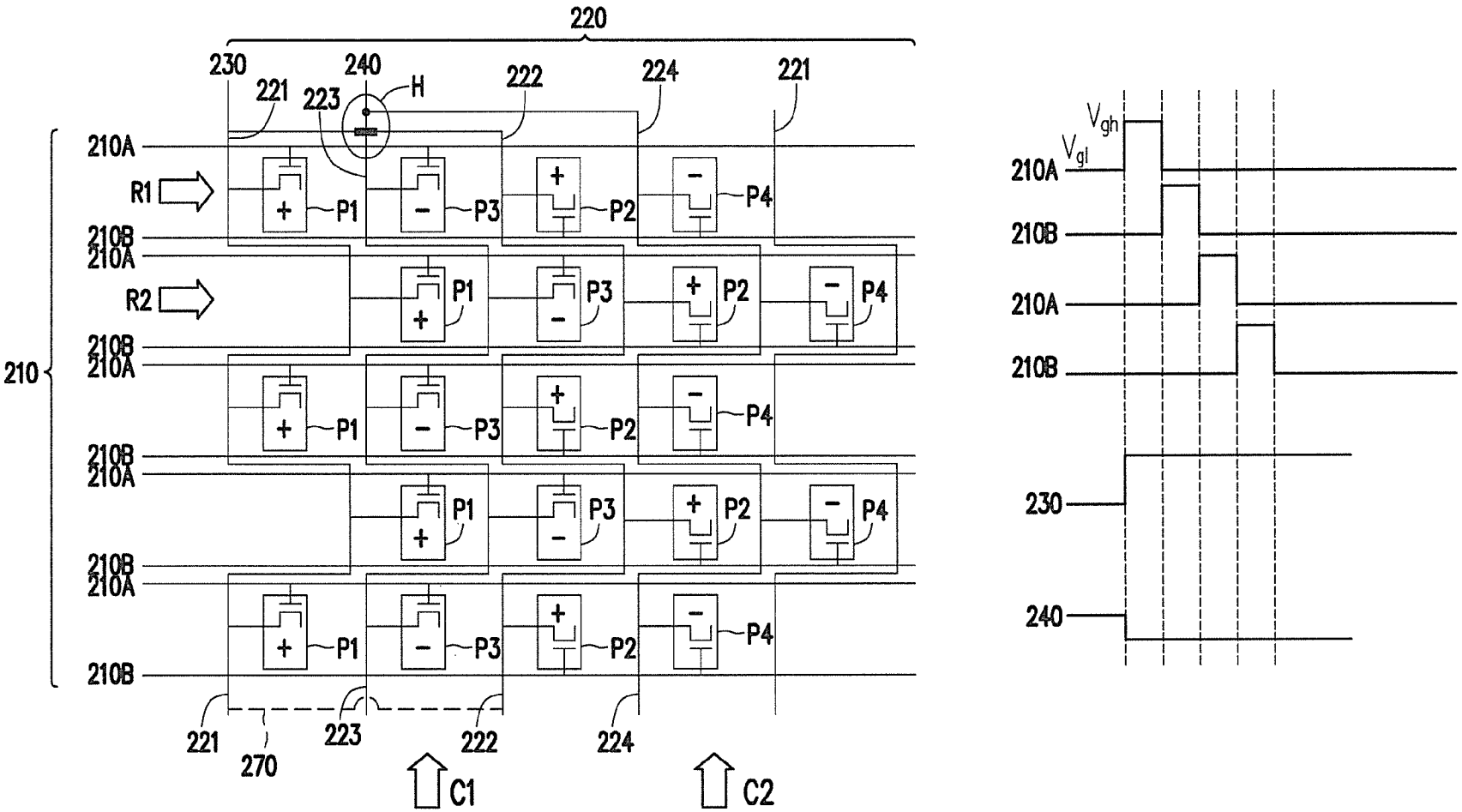
FIG. 3 is a schematic status of the pixel array of FIG. 2A under a driving method.

A driving method of a pixel array is exemplified by FIG. 2A. Referring to FIG. 3, a description for FIGS. 2 and 3 is provided in the following. FIG. 3 is a schematic status of the pixel array of FIG. 2A under a driving method. To facilitate illustration, signs "+" and "−" represent opposite polarities of voltage levels at various places in FIG. 3. For example, the signs "+" and "−" represent the positive polarity and the negative polarity respectively, and the signs are also used to determine the positive polarity and the negative polarity of each of the pixels P. Referring to FIG. 3, a schematic signal status of the pixel array 200 in FIG. 2 within a frame time is shown on the left of FIG. 3, more specifically, positive polarity and the negative polarity "+" and "−" are shown in FIG. 3. Driving waveforms of the scan lines 210 and the data lines 220 within a frame time are shown on the right of FIG. 3.

Referring to FIG. 3, according to the present embodiment, the first data line 221 and the second data line 222 are connected with each other to the first common conductive line 230, and the third data line 223 and the fourth data line 224 are connected with each other to the second common conductive line 240. Among the pixels of the same row, the portion of the pixels P connected to the second data line 222 and the fourth data line 224 are connected to the second scan line 210B. As shown in FIG. 3, in a first time period, a voltage of the first scan line 210A is an on-state voltage level $V_{gh}$, and as described above, the on-state voltage level $V_{gh}$ turns on pixels P1 of a row R1 connected to the first data line 221 and pixels P3 connected to the third data line 223 through the first scan line 210A. Further, the first data line 221 and the third data line 223 input data voltages of the positive polarity and the negative polarity through the first common conductive line 230 and the second common conductive line 240 to the pixels P1 and the pixels P3 of the row R1 turned on correspondingly. As a result, the pixels P1 and the pixels P3 of the row R1 within the frame time show the positive polarity "+" and the negative polarity "−" respectively.

Thereafter, as shown in FIG. 3, among the pixels of the same row, the portion of the pixels P connected to the second data line 222 and the fourth data line 224 are connected to the second scan line 210B. Thus, in a second time period, the voltage of the first scan line 210A is converted into an off-state voltage level $V_{g1}$, and the voltage of the second scan line 210B is the on-state voltage level $V_{gh}$. As described above, the on-state voltage level $V_{gh}$ turns on pixels P2 of the row R1 (the first row) connected to the second data line 222 and pixels P4 connected to the fourth data line 224 through the second scan line 210B. Further, the second data line 222 and the fourth data line 224 transmit the data voltages of the positive polarity and the negative polarity respectively through the first common conductive line 230 and the second common conductive line 240 to the pixels P2 and the pixels P4 of the row R1 turned on correspondingly. As a result, the pixels P2 and the pixels P4 of the row R1 within the frame time show the positive polarity "+" and the negative polarity "−" respectively.

Likewise, in a third time period, the voltage of the next first scan line 210A (the first scan line 210A in a second row R2) is an on-state voltage level $V_{gh}$. At this moment, the pixels P1 and the pixels P3 of the second row R2 (i.e., the next row of the first row) show the positive polarity "+" and the negative polarity "−" respectively. In a fourth time, the voltage of the next second scan line 210B (the second scan line 210B of the second row R2) is the on-state voltage level $V_{gh}$. At the moment, the pixels P2 and the pixels P4 of the second row R2 show the positive polarity "+" and the negative polarity "−" respectively. An operation principle of the pixels is similar as that described above and is therefore not repeated herein. As such, the first scan lines 210A and the second scan lines 210B of the pixel array 200 in the present invention are controlled according to the timing sequence and inputted line by line with the on-state voltage level $V_{gh}$ to the pixels P of different rows so as to show the status within a frame time as shown in FIG. 3.

Hence, the driving method of the pixel array in the present embodiment includes first inputting an on-state voltage level in sequence to the first scan lines 210A and the second scan lines 210B to sequentially turn on the pixels P. When or after the pixels P of the first row R1 are turned on, a data voltage of a first polarity and a data voltage of a second polarity are inputted to the pixels P of the first row R1 connected to the first scan line 210A through the first data line 221 and the third data line 223 respectively. The first polarity and the second polarity are different. The data voltage of the first polarity and the data voltage of the second polarity are inputted to the pixels P connected to the second scan line 210B of the first row R1 through the second data line 222 and the fourth data line 224 respectively. Afterwards, when or after the pixels P of the second row R2 are turned on, the data voltage of the first polarity and the data voltage of the second polarity are inputted through the first data line 221 and the third data line 223 respectively to the pixels P connected to the first scan line 210A of the second row R2. Further, the data voltage of the first polarity and the data voltage of the second polarity are inputted through the second data line 222 and the fourth data line 224 respectively to the pixels P connected to the second scan line 210B of the second row R2. In a frame time, the polarities of the data voltages transmitted by the data lines 221-224 remain unchanged.

It is noted that within the frame time, the polarity of the data voltage inputted to the same data line 220 does not convert as time goes by. In other words, the driving method of the pixel array 200 as enumerated in the present embodiment belongs to a column inversion driving mode. More specifically, in a frame time, the pixels P connected to the same data line 220 are inputted with the data voltage of the same polarity and thus show the same polarity status. However, as aforementioned, since the pixels P connected to the same data line 220 are not aligned in the column direction DC, the pixels P1 connected to the first data line 221 and the pixels P3 connected to the third data line 223 are aligned in the column direction DC, as shown by the column C1 of FIG. 3, and the pixels P2 connected to the second data line 222 and the pixels P4 connected to the fourth line 224 are aligned in the column direction DC as shown by a column C2 in FIG. 3. For the pixels P of the same column, e.g., the pixels P1 and P3, and the pixels P2 and P4, the data voltages of different polarities are inputted to show a display status with the positive polarity and the negative polarity in a cyclic sequence. Thus, users can obtain a display effect similar to that of the dot inversion driving mode by a simpler column inversion driving method. In other words, better display quality is achieved by a driving method consuming less electricity. Certainly, the driving method of the pixel array 200 of the present invention can also drive the pixel array 200 in a row inversion driving mode with a proper layout, and the present invention is not limited to the foregoing example.

The Second Embodiment

Figure 4:
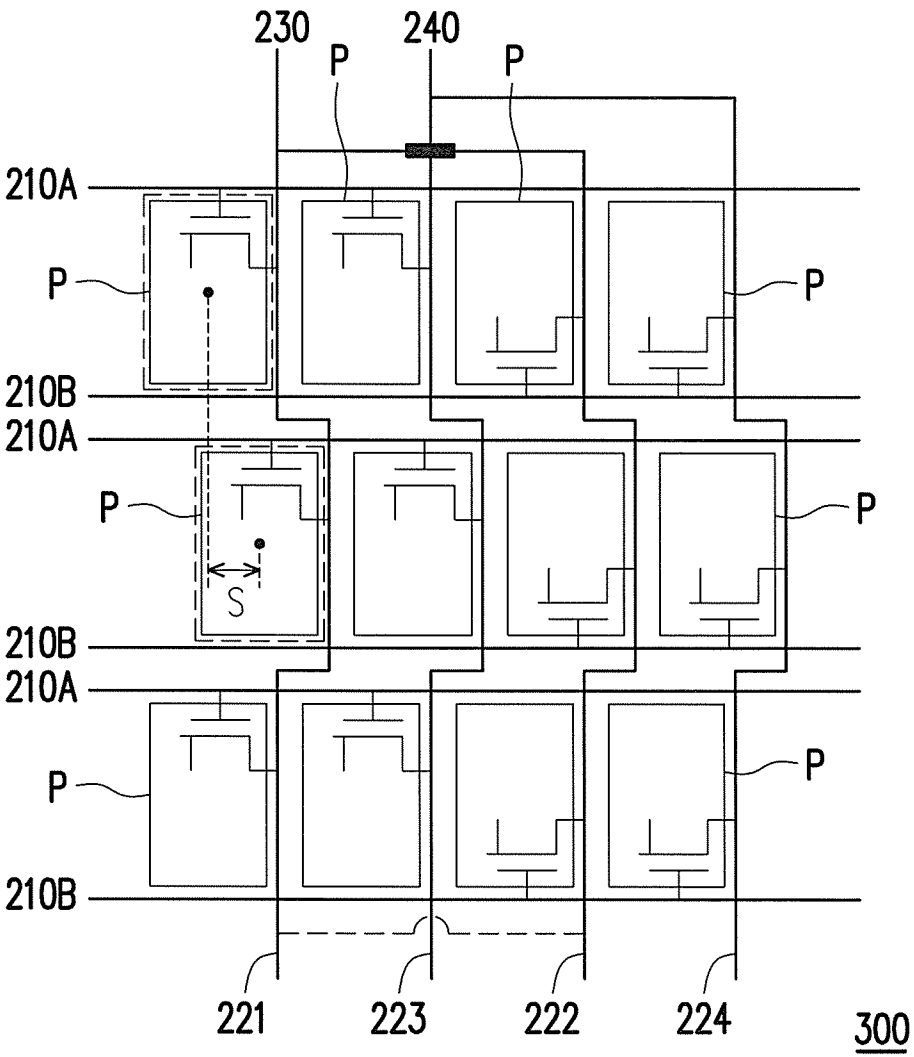
FIG. 4 is a schematic layout diagram of another pixel array according to an embodiment of the present invention.

FIG. 4 is a schematic layout diagram of another pixel array according to an embodiment of the present invention. Referring to FIG. 4, a pixel array 300 of the present embodiment is similar to the pixel array 200 of the first embodiment, and therefore elements similar to those of the first embodiment will be represented by the same reference numerals. However, compared with the first embodiment, in the pixel array 300 of the present embodiment, pixels P of even-numbered rows and pixels P of odd-numbered rows are not aligned in the column direction DC. In detail, in the row direction DR, a shift among the pixels P of different rows is one-$N^{th}$ (1/N) of a width of a pixel P, N≥2. For example, when N=2, a shift S among the pixels P of different rows is half of the width of the pixel P, for example. Meanwhile, the pixels P of the even-numbered rows can be substantially aligned with one another in the column direction DC, and the pixels in the odd-numbered rows can also be substantially aligned with one another in the column direction DC. Certainly, when N=3, the shift S among the pixels P of different rows is one-third of the width of the pixel P, for example. The same principle applies to the other instances.

Figure 5:
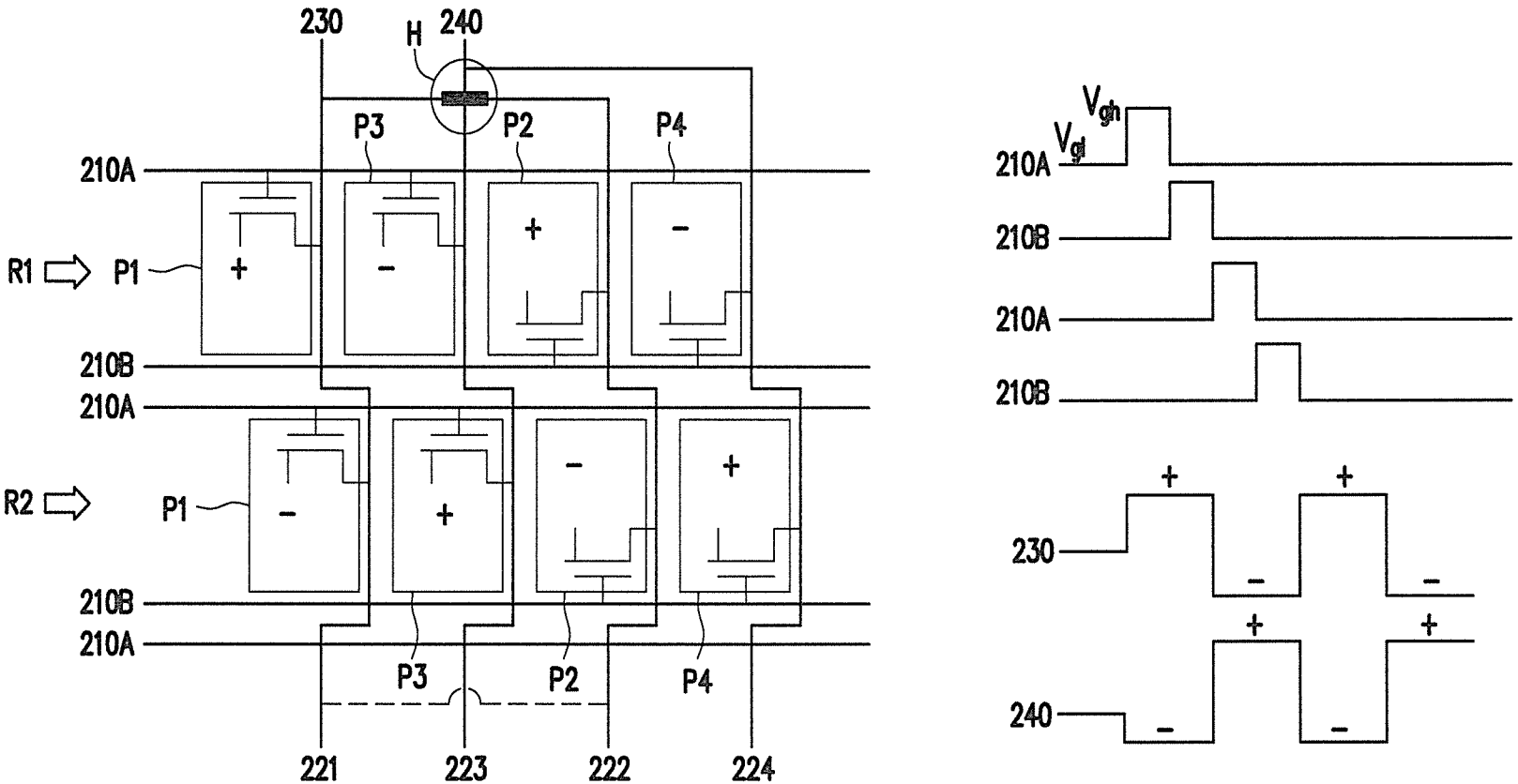
FIG. 5 is a schematic status of the pixel array of FIG. 4 under a driving method.

FIG. 5 is a schematic status diagram of the pixel array of FIG. 4 in a driving method. Referring to FIG. 5, a schematic signal status diagram of the pixel array 300 in FIG. 4 within a frame time is shown on the left of FIG. 5. Driving waveforms of the scan lines 210 and the data lines 220 within a frame time are shown on the right of FIG. 5.

Referring to FIG. 5, according to the present embodiment, likewise, the first data line 221 and the second data line 222 are connected with each other to the first common conductive line 230, and the third data line 223 and the fourth data line 224 are connected with each other to the second common conductive line 240. Among the pixels of the same row, the pixels P connected to the second data line 222 and the fourth data line 224 are connected to the second scan line 210B. As shown in FIG. 5, in the first time period, the voltage of the first scan line 210A is the on-state voltage level $V_{gh}$, and described above, the on-state voltage level $V_{gh}$ turns on the pixels P1 of the row R1 (the first row) connected to the first data line 221 and the pixels P3 connected to the third data line 223 through the first scan line 210A. Further, data voltages of the positive polarity and the negative polarity pass through the first common conductive line 230 and the second common conductive line 240 and are transmitted via first data line 221 and the third data line 223 respectively to the pixels P1 and the pixels P3 of the row R1 turned on correspondingly. As a result, the pixels P1 and the pixels P3 of the row R1 within the frame time show the positive polarity "+" and the negative polarity "−" respectively.

Thereafter, in the second time period, among the pixels of the same row (the first row), the portion of the pixels P connected to the second data line 222 and the fourth data line 224 are connected to the second scan line 210B. Likewise, the on-state voltage level $V_{gh}$ turns on the portion of the pixels P2 of the row R1 connected to the second data line 222 and the portion of the pixels P4 of the row R1 connected to the fourth data line 224 through the second scan line 210B (the second scan line 210B of the first row), and the second data line 222 and the fourth data line 224 transmit positive data voltages and negative data voltages to the turned-on pixels P2 and P4 respectively through the first common conductive line 230 and the second common conductive line 240 so that the pixels P2 and P4 of the row R1 within the frame time show the positive polarity "+" and the negative polarity "−" respectively.

Afterwards, in a third time period, the voltage of the next first scan line 210A (the first scan line 210A of the second row) is the on-state voltage level $V_{gh}$. At this moment, the voltage polarity of the first conductive line 220A switches from the positive polarity to the negative polarity, and the voltage polarity of the second conductive line 220B switches from the negative polarity to the positive polarity. Hence, the pixels P1 and P3 of the row R2 (the second row, i.e., the next row of the first row) are inputted respectively with data voltages of polarities different from those of the pixels P1 and P3 through the first data line 221 and the third data line 223, and the pixels P1 and P3 of the row R2 show the negative polarity "−" and the positive polarity "+" respectively. Likewise, the voltage of the next second scan line 210B (the second scan line 210B of the second row) is the on-state voltage level $V_{gh}$, and the voltage polarities of the first conductive line 220A and the second conductive line 220B are maintained the same as the negative polarity and the positive polarity in the third time period respectively. Therefore, the pixels P2 and P4 of the row R2 show the negative polarity "−" and the positive polarity "+" through the second data line 222 and the fourth data line 224 respectively, and the pixels P2 and P4 of the row R2 show the positive polarity "+" respectively. As such, the first scan line 210A and the second scan line 210B of the pixel array 300 in the present embodiment are controlled according to the timing sequence and inputted line by line with the on-state voltage level $V_{gh}$ to the pixels P of different rows so as to show the status within a frame time as shown in FIG. 5.

In other words, in the pixel array 300, a positive polarity distribution model and a negative polarity distribution model of any two adjacent pixels P serve as a unit U, and a cyclic variation shows in the row direction DR and the column direction DC. According to the present embodiment, the pixels P of adjacent rows are not aligned with one another in the column direction DC, and the present invention does not limit a relative shift ratio and a shape thereof between the positive polarity status and the negative polarity status of the pixel array 300.

Hence, the driving method of the pixel array in the present embodiment includes first inputting an on-state voltage level in sequence to the first scan lines 210A and the second scan lines 210B to turn on the pixels P sequentially. When or after the pixels P of the first row R1 are turned on, a data voltage of the first polarity and a data voltage of the second polarity are inputted to the pixels P connected to a first scan line 210A of the first row R1 through the first data line 221 and the third data line 223 in the first row respectively. The first polarity and the second polarity are different. The data voltage of the first polarity and the data voltage of the second polarity are inputted to the pixels P connected to the second scan line 210B of the first row R1 through the second data line 222 and the fourth data line 224 respectively. Afterwards, when or after the pixels P of the second row R2 are turned on, the data voltage of the second polarity and the data voltage of the first polarity are inputted to the pixels P connected to the first scan line 210A of the second row R2 through the first data line 221 and the third data line 223 of the second row R2 respectively. Further, the data voltage of the second polarity and the data voltage of the first polarity are inputted to the pixels P connected to the second scan line 210B of the second row R2 through the second data line 222 and the fourth data line 224 respectively. It is known from FIG. 5 that within a frame time the data voltages of the first polarity and the second polarity transmitted by one of the data lines 221-224 alternate in sequence.

It should be noted that as shown in FIG. 5 within the frame time the driving method as enumerated for driving the pixel array 300 belongs to a row inversion driving mode. More specifically, the pixel array 300 of the present invention allows users to achieve a display effect similar to that of dot inversion driving mode by a simpler row inversion driving method. In other words, the driving method consuming less electricity is applied to achieve better display quality, thereby lowering the manufacturing cost. Certainly, the driving method of the pixel array of the present invention can also drive the pixel array by the column inversion driving mode with a proper layout, and the present invention does not limit in this aspect.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A pixel array, comprising:

a plurality of scan lines, substantially extending along a row direction, the scan lines comprising:

a plurality of first scan lines;

a plurality of second scan lines, wherein the first scan lines and the second scan lines are alternately arranged substantially along a column direction;

a plurality of data lines, substantially extending along the column direction in a zigzag manner, the data lines comprising:

a first data line;

a second data line, connected to the first data line;

a third data line, disposed between the first data line and the second data line; and a fourth data line, connected to the third data line; and a plurality of pixels, connected to the scan lines and the data lines correspondingly, wherein the pixels connected to the same data line are not aligned in the column direction, the pixels connected to the same data line are only distributed at the same side of the data line, and the pixels of any two adjacent rows are separated by one of the first scan lines and one of the second scan lines.

2. The pixel array as claimed in claim 1, wherein at least one of the first data line, the second data line, the third data line and the fourth data line comprises:

a plurality of first conductive lines, extending along the row direction; and a plurality of second conductive lines, extending along the column direction, wherein the first conductive lines and the second conductive lines are connected.

3. The pixel array as claimed in claim 1, wherein a portion of the pixels connected to the first data line and a portion of the pixels connected to the third data line are aligned in the column direction, and a portion of the pixels connected to the second data line and a portion of the pixels connected to the fourth data line are aligned in the column direction.

4. The pixel array as claimed in claim 1, wherein the pixels of even-numbered rows and the pixels of odd-numbered rows are not aligned in the column direction.

5. The pixel array as claimed in claim 4, wherein a shift of the pixels in different rows in the row direction is one-$N^{th}$ of a width of the pixel, and N is larger than or equal to 2.

6. The pixel array as claimed in claim 1, wherein among the pixels of the same row, portions of the pixels connected to the first data line and the third data line are connected to one of the first scan lines, and portions of the pixels connected to the second data line and the fourth data line are connected to one of the second scan lines.

7. The pixel array as claimed in claim 1, further comprising a conductive layer, wherein the conductive layer and the data lines are formed by different layers, and each of the second data lines is connected to each of the first data lines through the conductive layer.

8. A driving method for driving the pixel array as claimed in claim 1, the driving method comprising:

inputting an on-state voltage level sequentially to the first scan lines and the second scan lines to turn on the pixels sequentially;

inputting a data voltage of a first polarity and a data voltage of a second polarity to the pixels connected to the first scan line in a first row through the first data line and the third data line respectively, wherein the first polarity and the second polarity are different; and inputting the data voltage of the first polarity and the data voltage of the second polarity to the pixels connected to the second scan line in the first row through the second data line and the fourth data line respectively.

9. The driving method as claimed in claim 8, wherein the polarities of the data voltages transmitted by each of the data lines remain unchanged within a frame time.

10. The driving method as claimed in claim 8, further comprising:

inputting the data voltage of the first polarity and the data voltage of the second polarity to the pixels connected to the first scan line in a second row through the first data line and the third data line respectively; and inputting the data voltage of the first polarity and the data voltage of the second polarity to the pixels connected to the second scan line in the second row through the second data line and the fourth data line respectively.

11. The driving method as claimed in claim 10, wherein the polarities of the data voltages transmitted by each of the data lines remain unchanged within a frame time.

12. The driving method as claimed in claim 8, further comprising:

inputting the data voltage of the second polarity and the data voltage of the first polarity to the pixels connected to the first scan line in a second row through the first data line and the third data line respectively; and inputting the data voltage of the second polarity and the data voltage of the first polarity to the pixels connected to the second scan line in the second row through the second data line and the fourth data line respectively.

13. The driving method as claimed in claim 12, wherein the data voltage of the first polarity and the data voltage of the second polarity transmitted by one of the data lines are alternate in sequence.

14. The pixel array as claimed in claim 1, wherein the pixels connected to the different data lines are only distributed at the same side of the corresponding data line.

15. The pixel array as claimed in claim 1, wherein the pixels of the same row are aligned in the row direction, and among the pixels of the same row, portions of the pixels connected to one of the first scan lines, and portions of the pixels connected to one of the second scan lines.

16. A pixel array, comprising:

a plurality of scan lines, substantially extending along a row direction, the scan lines comprising:

a plurality of first scan lines;

a plurality of second scan lines, wherein the first scan lines and the second scan lines are alternately arranged substantially along a column direction;

a plurality of data lines, substantially extending along the column direction in a zigzag manner, the data lines comprising:

a first data line;

a second data line, connected to the first data line;

a third data line, disposed between the first data line and the second data line; and a fourth data line, connected to the third data line; and a plurality of pixels, connected to the scan lines and the data lines correspondingly, wherein the pixels connected to the same data line are not aligned in the column direction, the pixels connected to the same data line are only distributed at the same side of the data line, and the pixels of every two adjacent rows are separated by one of the first scan lines and one of the second scan lines, the pixels in the same row comprising:

a first pixel, connected to the first data line;

a second pixel, connected to the second data line;

a third pixel, connected to the third data line;

a fourth pixel, connected to the fourth data line; and among the pixels of the same row, the first pixels connected to the first data line and the third pixels connected to the third data line are connected to one of the first scan lines, and the second pixels connected to the second data line and the fourth pixels connected to the fourth data line are connected to one of the second scan lines, the second pixels connected to the second data line are aligned with the fourth pixels connected to the fourth data line in the column direction.

17. The pixel array as claimed in claim 1, wherein the pixels in the same row comprising:

a first pixel, connected to the first data line;

a second pixel, connected to the second data line;

a third pixel, connected to the third data line;

a fourth pixel, connected to the fourth data line; and the first pixels and the third pixels are connected to one of the first scan lines, and the second pixels and the fourth pixels are connected to one of the second scan lines.

18. The pixel array as claimed in claim 1, wherein a polarity of the first pixels is the same as a polarity of the third pixels.

* * * * *